US007533762B2

(12) United States Patent
Kuttel et al.

(10) Patent No.: US 7,533,762 B2
(45) Date of Patent: May 19, 2009

(54) LIFT WITH SUPPORT MEANS AND DRIVE MEANS

(75) Inventors: Heinrich Kuttel, Weggis (CH); Danilo Peric, Lucerne (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/738,630

(22) Filed: Apr. 23, 2007

(65) Prior Publication Data

US 2008/0041668 A1 Feb. 21, 2008

(30) Foreign Application Priority Data

May 3, 2006 (EP) ..... 06113439

(51) Int. Cl.
*B66B 11/08* (2006.01)
*B66B 11/04* (2006.01)

(52) U.S. Cl. ..... 187/266; 187/251

(58) Field of Classification Search ..... 187/250, 187/266, 411, 412; 24/115 M, 136 L, 136 R
See application file for complete search history.

(56) References Cited

U.S. PATENT DOCUMENTS 2,687,209 A * 8/1954 Rost et al. ..... 198/690.2
4,664,229 A * 5/1987 Obst ..... 187/411
4,986,391 A * 1/1991 Salmon ..... 187/411
6,499,566 B2 * 12/2002 Ach ..... 187/264
6,662,408 B2 * 12/2003 Perez et al. ..... 24/136 R
2004/0055831 A1 * 3/2004 Huber ..... 187/412
2006/0102434 A1 * 5/2006 Nomura et al. ..... 187/266

FOREIGN PATENT DOCUMENTS

EP 1 367 017 A 12/2003
GB 2269575 A * 2/1994
JP 55 007151 A 1/1980

* cited by examiner

*Primary Examiner*—Peter M Cuomo
*Assistant Examiner*—Eric Pico
(74) *Attorney, Agent, or Firm*—Schweitzer Cornman Gross & Bundell LLP

(57) ABSTRACT

A lift has a lift cage movable in a lift shaft and is connected with a counterweight by means of at least one support means. The lift cage or counterweight moves by means of at least one drive means separate from the support means. One end of the drive means engages the upper end of the counterweight, is guided by way of a drive pulley and by way of a deflecting roller, and engages at its other end with the lower end of the counterweight. A drive unit drives the drive pulley. The drive means consists of a drive part and a tension part of different characteristics, wherein the drive and tension parts are connected by means of a drive means connection.

6 Claims, 6 Drawing Sheets

LIFT WITH SUPPORT MEANS AND DRIVE MEANS

The present invention relates to a lift with a lift cage movable in a lift shaft and a counterweight movable in the lift shaft, wherein the lift cage and counterweight are connected by means of at least one support means and are movable up and down by means of at least one drive means, wherein the drive means is guided by way of a drive pulley drivable by means of a drive unit.

BACKGROUND OF THE INVENTION

A lift has become known from Patent Specification GB 1 027 714, in which a lift cage is connected with a counterweight by means of support means guided by way of deflecting rollers. The lift cage or the counterweight is moved up and down by a drive means, which is separate from the support means and which engages at one end with the upper end of the counterweight, is guided by way of an upper and a lower deflecting roller and engages at the other end with the lower end of the counterweight. The drive means can also engage at the lift cage instead of at the counterweight. A drive unit drives the drive means.

A disadvantage of the known equipment resides in the fact that the use of an additional drive means, which drive means drives the counterweight and the lift cage, provides a corresponding increase in cost.

BRIEF DESCRIPTION OF THE INVENTION

The present invention overcomes disadvantages of the prior art and fulfils the object of avoiding the disadvantages of known equipment and of providing a lift equipment construction in which support means and drive means are separate and merely one drive means is provided.

In accordance with the invention drive means are provided in which the drive means has separate drive and tension parts.

The advantages achieved by the invention are substantially to be seen in that with the use of modern drive means such as belts, synthetic fibre cables (for example aramide cables), double cables (for example two synthetic fibre cables with a common casing) or uncased steel cables it is possible to make use of drive pulleys or deflecting rollers with smaller diameters, because smaller bending radii are permissible. While modern drive means are more expensive than conventional steel cables, with the equipment according to the invention it is nevertheless possible to provide an economic lift, particularly with substantial conveying heights. This is achieved by division of the drive means into two parts, a drive part and a tension part, wherein the two parts are connected by means of a drive means connection or lock. A modern drive means, as mentioned above, is used for the drive part, while a conventional steel cable may be used for the tension part. The characteristics and advantages of both modern drive means and conventional steel cables can thus be combined in one lift. In addition, it is advantageous that with the use of modern drive means the entire drive unit can be of a smaller size.

In the equipment according to the invention a lift cage and a counterweight are connected by means of at least one support means and are raised and lowered by means of at least one drive means, wherein the drive means is guided by way of a drive pulley drivable by means of a drive unit and the drive means consists of a drive part and a tension part, wherein the drive and tension parts are of different characteristics.

BRIEF DESCRIPTION OF THE DRAWINGS

The present invention is explained in more detail by way of the accompanying figures, in which.

DETAILED DESCRIPTION OF THE INVENTION

Figure 1:
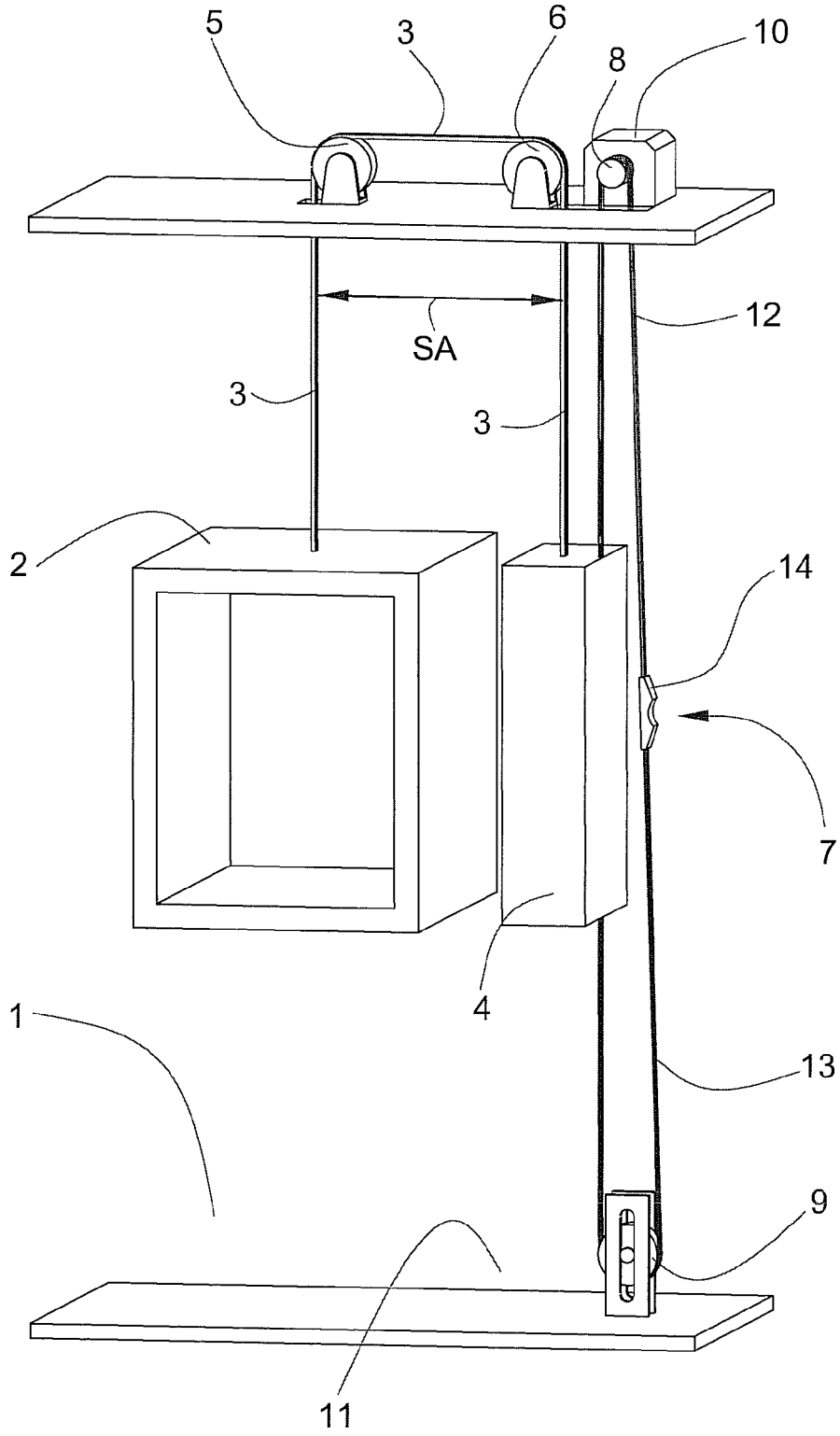
FIG. 1 is a diagrammatic presentation of a lift with support means and drive means, the drive means engaging a counterweight in accordance with the invention.

FIG. 1 shows a lift with a 1:1 support means and drive means course. A lift cage 2, movable in a lift shaft 1 is connected with a counterweight 4 by means of at least one support means 3. Lift cage 2 and counterweight 4 are guided in the lift shaft 1 by means of guide rails (not illustrated). A first deflecting roller 5 and a second deflecting roller 6 ensure the requisite cable run spacing SA between lift cage 2 and counterweight 4. Conventional steel lift cables, belts (for example, flat belts or wedge-ribbed belts), synthetic fibre cables (for example aramide cables), double cables of synthetic fibres or uncased steel cable can be provided as the support means 3. Only one support means 3 is illustrated. However, several support means 3, guided parallel to one another, can be provided.

The lift cage 2 or the counterweight 4 is raised and lowered by means of at least one drive means 7, separate from the support means 3. The drive means 7 engages the upper end of the counterweight 4 at one end, is guided by way of a drive pulley 8 of a third deflecting roller 9, and engages the lower end of the counterweight 4 at its other end. A drive unit 10 drives the drive pulley. The third deflecting roller 9 is arranged in a shaft pit 11, and provides tension to the drive means 7.

The drive means 7 includes a drive part 12 and a tension part 13, wherein the parts 12, 13 are different in construction and are connected by means of a drive means connection 14. The drive part 12 engages the upper end of the counterweight 4 at one end, is guided by way of the drive pulley 8, and is connected at its other end with the drive means connection 14. The tension part 13 is connected at one end with the drive means connection 14, is guided by way of the third deflecting roller 9, and engages the counterweight at its other end.

Belts (for example flat belts or wedge-ribbed belts), synthetic fibre cables (for example aramide cables), double cables (for example two synthetic fibre cables with a common casing) or uncased steel cables may be provided as drive means 12. Only one drive means 7 is illustrated. However, several drive means 7, guided in parallel, can also be provided. Conventional steel lift cables are provided as tension part 13. The costs for the drive part 12 are approximately ten times higher than the costs for the tension part 13, which influences the production costs for the entire lift.

In the 1:1 support means and drive means course shown in FIG. 1 the drive pulley 8 moves the drive means 7 the same number of meters as the lift cage 2 or the counterweight 4 rises and lowers.

Figure 2:
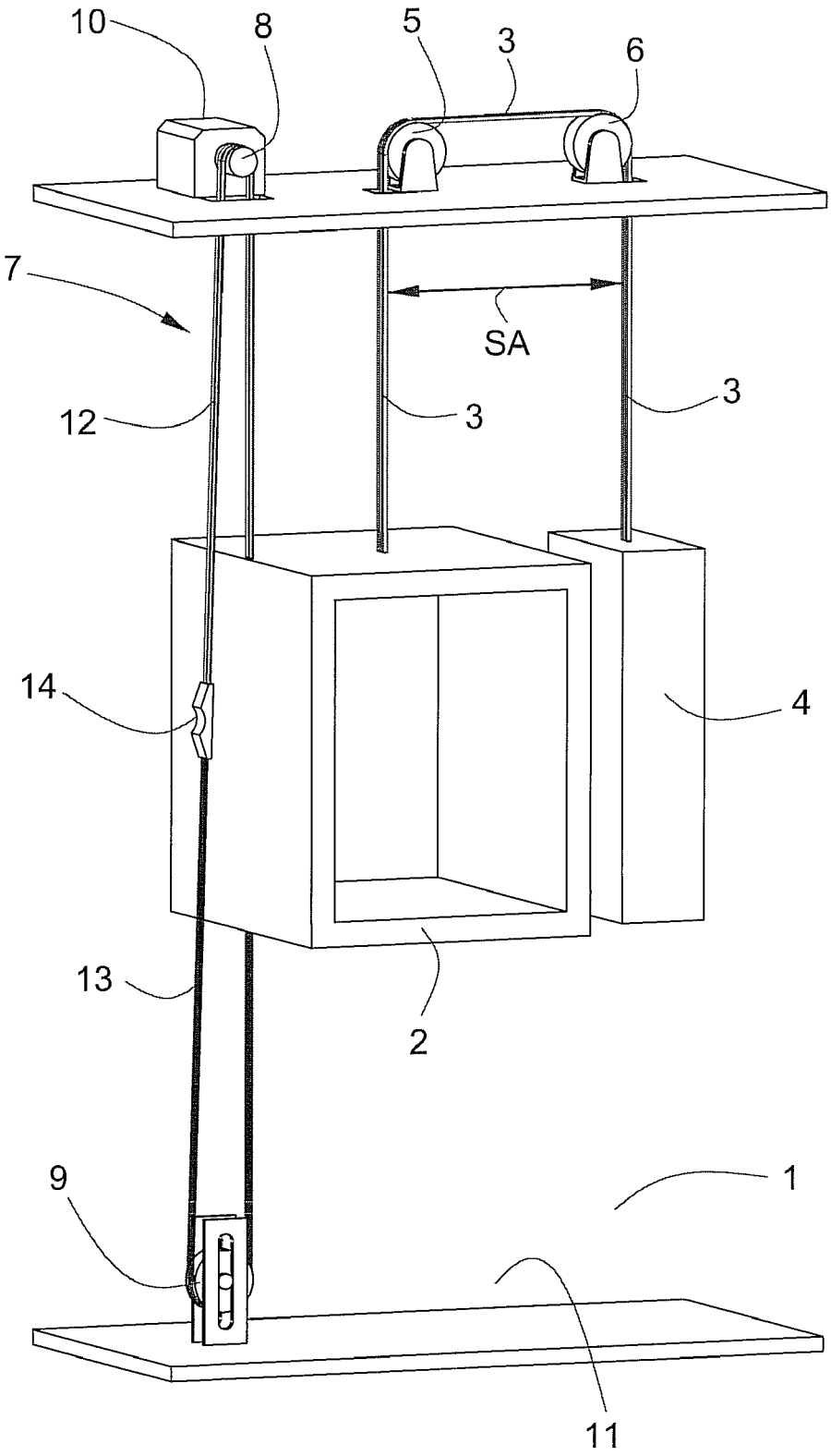
FIG. 2 shows a lift in accordance with the invention with support means and drive means, the drive means engaging a lift cage.

As shown in FIG. 2, the drive means 7 can also engage the lift cage 2 instead of the counterweight 4. The construction and mode of operation correspond to that of the equipment as shown in FIG. 1.

Figure 3:
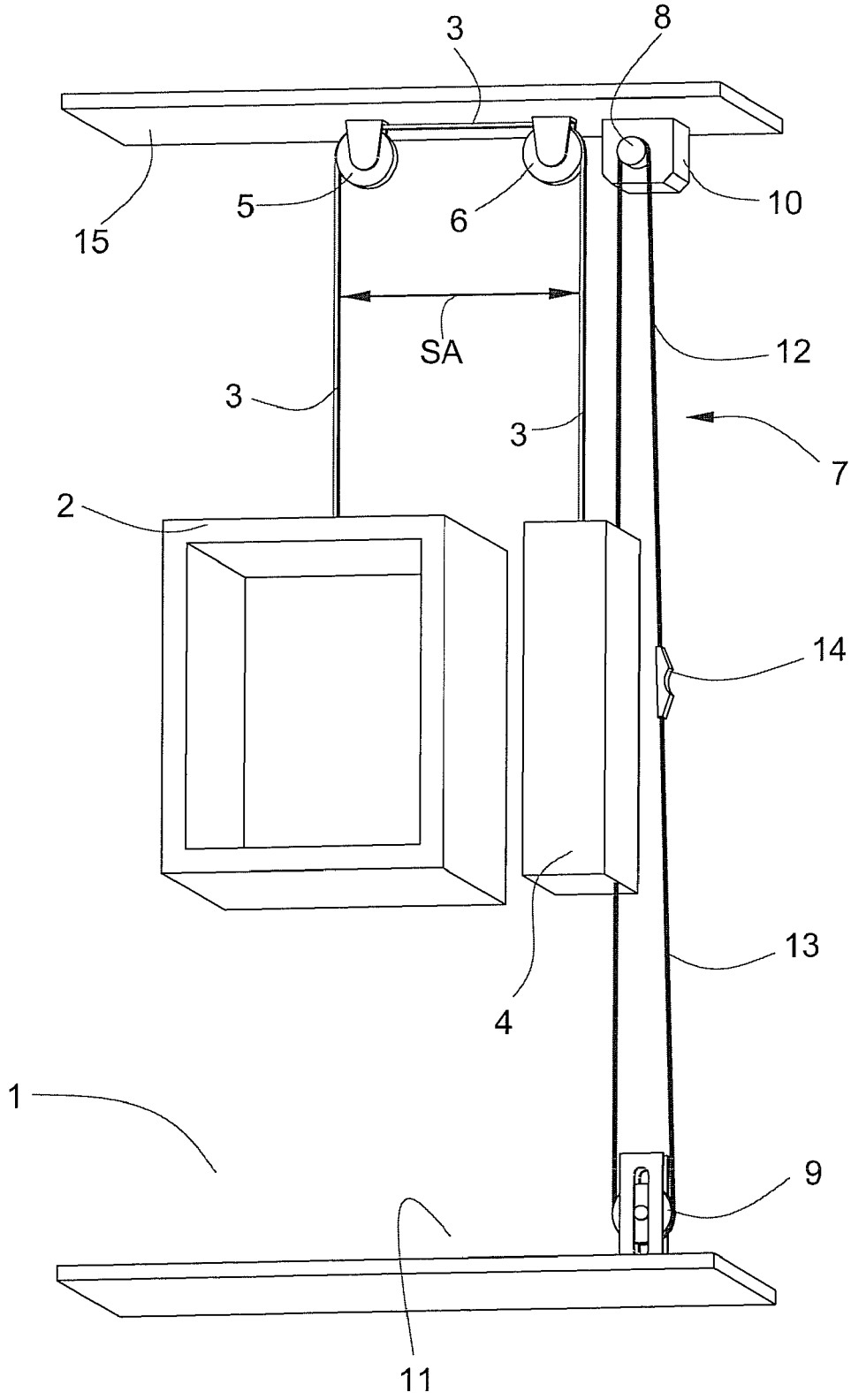
FIG. 3 shows a lift in accordance with the invention, without an engine room, with support means and drive means, the drive means engaging a counterweight.

FIG. 3 shows a lift, which does not have an engine room, with support means 3 and with drive means 7 engaging the counterweight 4. The construction and mode of operation correspond to that of the equipment shown in FIG. 1. Drive unit 8 and deflecting rollers 5, 6 can be arranged at the guide rails (not illustrated) instead of at the shaft ceiling 15.

Figure 4:
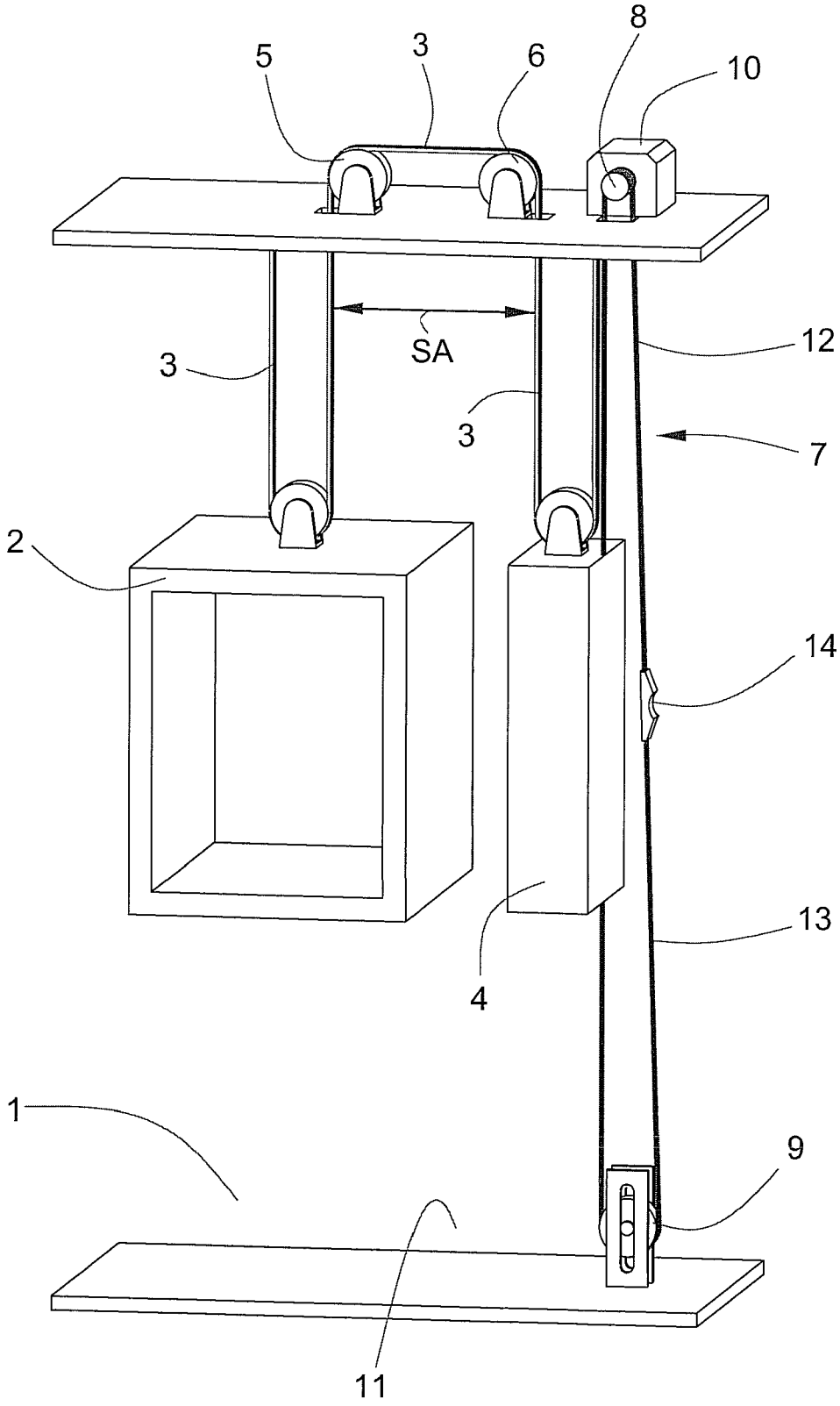
FIG. 4 shows a lift of the invention with a 2:1 support means course and a 1:1 drive means course.

FIG. 4 shows a lift with a 2:1 support means course and a 1:1 drive means course. The ends of the support means 3 are each fixed to a respective cable fixing point (not illustrated). The support means 3 is guided by way of a first deflecting roller at the lift cage 2 and a second deflecting roller at the counterweight 4. The forces in the support means 3 are halved by the illustrated 2:1 support means course. The construction and mode of operation of the drive means 7 correspond to that of the equipment shown in FIG. 1.

Figure 5:
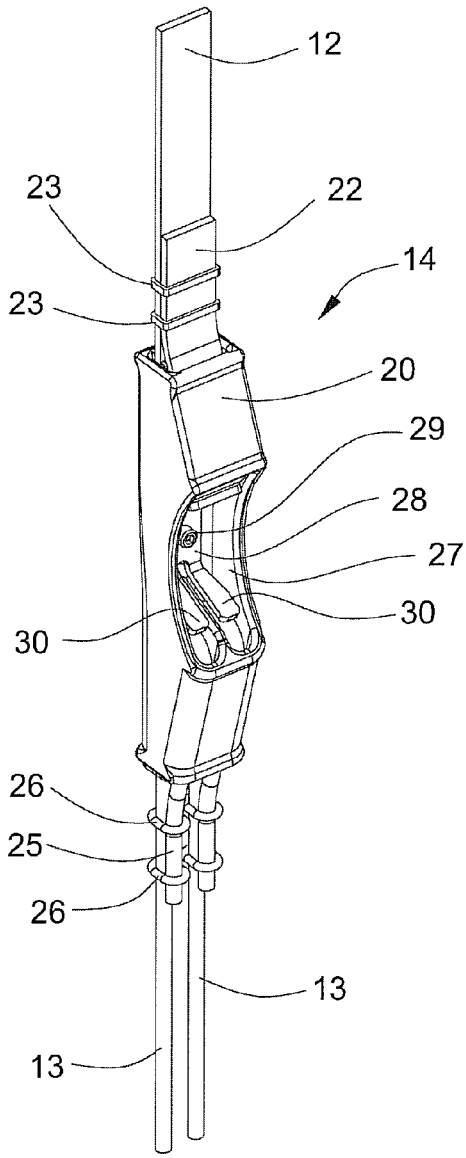
FIG. 5 is a perspective view of a drive means connection of the invention.
Figure 6:
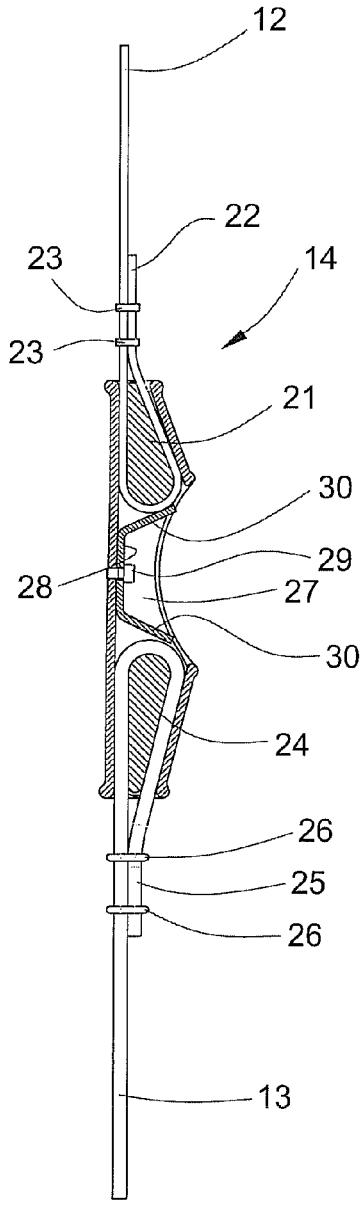
FIG. 6 is a section view of the drive means connection.

FIG. 5 and FIG. 6 show details of the drive means connection 14. The drive part 12 loops around at least one first wedge 21 arranged in a housing 20, wherein the drive part end 22 is fixed to the drive part by means of first clamps 23. In the illustrated example the drive part 12 consists of a belt. The tension part 13 loops around at least one second wedge 24 also arranged in the housing 20, wherein the tension part end 25 is fixed to the tension part 13 by means of second clamps 26. In the illustrated example the tension part 13 consists of two cables. The housing has an opening 27 through which a double shackle 28 is insertable. The double shackle 28 is detachably connectible with the housing 20 by means of at least one screw 29. The double shackle 28 has straps 30 with spring characteristics that engage the wedges 21, 24 and the respective looped drive part and tension part portions, preventing dropping of the wedges 21, 24 out of the housing 20.

In an alternate embodiment the drive unit 8 can be arranged in the shaft pit or laterally of the shaft pit. The drive pulley is provided instead of the third deflecting roller and the third deflecting roller is provided instead of the drive pulley. The relative positions of the drive part and the tension part are similarly reversed.

A compensating cable can be provided between the lift cage and the counterweight, particularly in the case of lift installations with substantial conveying heights.

Figure 7:
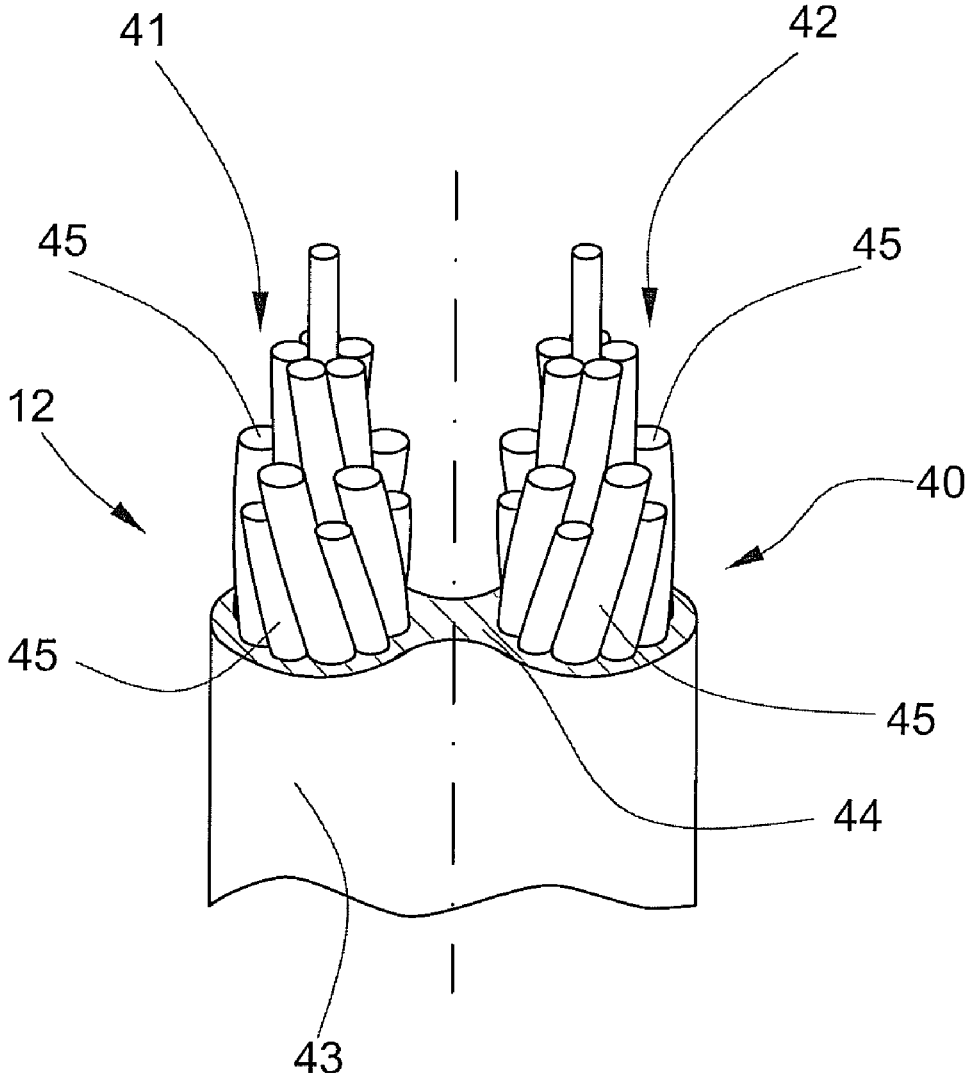
FIG. 7 is a detail perspective view depicting a double cable used as a drive means.

FIG. 7 shows a double cable 40 as drive part 12. The double cable 40 consists of a first cable 41 and of a second cable 42, wherein the cables 41, 42 are surrounded by a common casing 43, the casing 43 having a constriction or a web 44 between the cables 41, 42. Each cable 41, 42 consists of several strands 45, each of which in turn consists of several synthetic fibres (not illustrated). The strands 45 are twisted relative to one another, wherein the direction of twist of the first cable 41 is in an opposite sense to the direction of twist of the second cable 42. This has the effect of neutralizing any untwisting forces in the web 44. The surface of the drive pulley 8, the housing 20, and the first wedge 21 of the drive means connection 14 are constructed for reception of the double cable 40 in correspondence with the cross-section of the cable casing, shown hatched in FIG. 7.

We claim:

1. A lift, comprising a lift cage and a counterweight both movable in a lift shaft, the lift cage and counterweight being connected by means of at least one support means, and at least one independent drive means guided by way of a drive pulley drivable by a drive unit for raising and lowering the lift cage and counterweight and having opposed first and second ends connected respectively to an upper and a lower end of the lift cage or an upper and a lower end of the counterweight, the drive means comprising a drive part and a tension part, wherein the drive and tension parts are of different characteristics and have ends joined directly together by a drive means connection.

2. The lift according to claim 1, wherein the drive part has a first end engaging an upper end of the counterweight, is guided by the drive pulley, and has a second end connected to the drive means connection and the tension part has a first end connected to the drive means connection, is guided by way of a deflecting roller, and has a second end connected to a lower end of the counterweight.

3. The lift according to claim 2, wherein the drive means connection comprises a housing in which at least one wedge is provided for fixing the drive part and at least one wedge is provided for fixing the tension part.

4. The lift according to claim 3, wherein the drive means connection further includes biasing means for retaining the wedges within the housing, the housing having an opening for insertion of the biasing means.

5. A drive means connection for use in a lift comprising a lift cage and a counterweight both movable in a lift shaft, the lift cage and counterweight being connected by means of at least one support means, and at least one drive means guided by way of a drive pulley driveable by a drive unit for raising and lowering the lift cage and counterweight, the drive means comprising a drive part and a tension part wherein the drive and tension parts are of different characteristics, the drive means connection comprising a housing, an end of each of the drive part and the tension part directly inserted into the housing through opposite ends thereof, at least one wedge for fixing the drive part, and at least one wedge for fixing the tension part, each of the drive part and the tension part having a distal end connected to opposed ends of either the lift cage or the counterweight.

6. The drive means connection according to claim 5, wherein the drive means connection further includes biasing means for retaining the wedges within the housing, the housing having an opening for insertion of the biasing means.

* * * * *